US006019111A

United States Patent [19]

Gillies

[11] Patent Number: 6,019,111

[45] Date of Patent: Feb. 1, 2000

[54] PAINT ROLLER CLEANING SYSTEM

[76] Inventor: Boyce W. Gillies, Box 37, Whitewood, S. Dak. 57793-0037

[21] Appl. No.: 09/292,632

[22] Filed: Apr. 15, 1999

[51] Int. Cl.[7] ..... B08B 3/02

[52] U.S. Cl. ..... 134/138; 134/900

[58] Field of Search ..... 134/900, 138, 134/172

[56] References Cited

U.S. PATENT DOCUMENTS

| | | | |
|---|---|---|---|
| 2,938,368 | 5/1960 | Bixel | 134/900 X |
| 3,688,785 | 9/1972 | Stevens et al. | 134/138 |
| 4,672,987 | 6/1987 | Brandt | 134/900 X |

*Primary Examiner*—Philip R. Coe
*Attorney, Agent, or Firm*—Michael S. Neustel

[57] ABSTRACT

A paint roller cleaning system for cleaning a paint roller in a confined and controlled environment thereby preventing outside contamination. The inventive device includes a housing, a first cover attached to a portion of the open end, a second cover pivotally attached to the housing opposite of the first cover, a centrally positioned notch within the first cover and the second cover, a dispensing tube having a plurality of nozzles slidably extending through the first cover through an aperture, an elbow member attached to the dispensing tube, a compression spring secured about the dispensing tube between the first cover and the elbow member, an entry tube attached to the elbow member, and a hose coupler secured to the entry tube for threadably attaching to a conventional garden hose. Water supplied to the hose coupler is dispensed through the nozzles within the dispensing tube toward the sleeve of the conventional paint roller. As the water engages the sleeve, the sleeve is rotated upon the conventional paint roller while the user simultaneously lowers and raises the dispensing tube to ensure complete saturation of the sleeve. As the sleeve rotates the centrifugal force removes the water-paint mixture toward the interior walls of the housing where after it drains to the bottom of the housing. The housing is utilized to dispose of the water-paint mixture when finished cleaning the sleeve.

20 Claims, 4 Drawing Sheets

PAINT ROLLER CLEANING SYSTEM

BACKGROUND OF THE INVENTION

1. Field of the Invention

The present invention relates generally to paint rollers and more specifically it relates to a paint roller cleaning system for cleaning a paint roller in a confined and controlled environment thereby preventing outside contamination.

Paint rollers/sleeves are utilized by individuals to apply water based paint to walls and other structures. It is desirable to clean the paint rollers to allow reuse of the paint roller. To clean a paint roller the user typically will either soak the roller in a bucket of water or utilize a spray nozzle attached to a garden hose to spray the paint off the paint roller. Placing the roller in a bucket of water is not desirable since the paint within the paint roller is difficult to remove without a minimal amount of agitation. Utilizing a garden hose and spray nozzle is not desirable since the removed paint will often be dispersed upon the user and surrounding objects. Hence, there is a need for a paint roller cleaning system that will effectively clean a conventional paint roller without removed paint engaging the user or surrounding objects.

2. Description of the Prior Art

Paint rollers have been in use for years. Typically, a conventional paint roller includes an arm member and a cylindrical frame that is rotatably supported upon the distal end of the arm member. The cylindrical frame removably receives a sleeve that absorbs and dispenses the paint upon a wall or other structure. After utilizing the conventional paint roller for a period of time, it is desirable to clean the sleeve to increase the efficiency and quality of painting.

Unfortunately, the only feasible method of cleaning a sleeve of a conventional paint roller is to utilize a garden hose with a spray nozzle to spray the accumulated paint off the sleeve. This is extremely messy and time consuming for the individual. In addition, the user must conduct the cleaning outside to avoid contaminating the interior structure of a building. The only other alternative is to throw away the sleeve and attach a new sleeve which can be expensive over a period of time.

While these devices may be suitable for the particular purpose to which they address, they are not as suitable for cleaning a paint roller in a confined and controlled environment thereby preventing outside contamination. Spraying a conventional paint roller is extremely messy and time consuming.

In these respects, the paint roller cleaning system according to the present invention substantially departs from the conventional concepts and designs of the prior art, and in so doing provides an apparatus primarily developed for the purpose of cleaning a paint roller in a confined and controlled environment thereby preventing outside contamination.

SUMMARY OF THE INVENTION

In view of the foregoing disadvantages inherent in the known types of paint roller cleaners now present in the prior art, the present invention provides a new paint roller cleaning system construction wherein the same can be utilized for cleaning a paint roller in a confined and controlled environment thereby preventing outside contamination.

The general purpose of the present invention, which will be described subsequently in greater detail, is to provide a new paint roller cleaning system that has many of the advantages of the paint roller cleaners mentioned heretofore and many novel features that result in a new paint roller cleaning system which is not anticipated, rendered obvious, suggested, or even implied by any of the prior art paint roller cleaners, either alone or in any combination thereof.

To attain this, the present invention generally comprises a housing, a first cover attached to a portion of the open end, a second cover pivotally attached to the housing opposite of the first cover, a centrally positioned notch within the first cover and the second cover, a dispensing tube having a plurality of nozzles slidably extending through the first cover through an aperture, an elbow member attached to the dispensing tube, a compression spring secured about the dispensing tube between the first cover and the elbow member, an entry tube attached to the elbow member, and a hose coupler secured to the entry tube for threadably attaching to a conventional garden hose. Water supplied to the hose coupler is dispensed through the nozzles within the dispensing tube toward the sleeve of the conventional paint roller. As the water engages the sleeve, the sleeve is rotated upon the conventional paint roller while the user simultaneously lowers and raises the dispensing tube to ensure complete saturation of the sleeve. As the sleeve rotates the centrifugal force removes the water-paint mixture toward the interior walls of the housing where after it drains to the bottom of the housing. The housing is utilized to dispose of the water-paint mixture when finished cleaning the sleeve.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a paint roller cleaning system that will overcome the shortcomings of the prior art devices.

Another object is to provide a paint roller cleaning system that effectively cleans a sleeve of a conventional paint roller.

An additional object is to provide a paint roller cleaning system that can be utilized within a building structure.

A further object is to provide a paint roller cleaning system that an individual to reuse a sleeve of a conventional paint roller numerous times.

Another object is to provide a paint roller cleaning system that makes painting more enjoyable.

An additional object is to provide a paint roller cleaning system that increases the quality of a paint job.

Another object is to provide a paint roller cleaning system that allows safe disposal of waste water contaminated with the removed paint.

An additional object is to provide a paint roller cleaning system that is self contained.

Another object is to provide a paint roller cleaning system that significantly reduces the time it takes to clean a conventional paint roller.

Another object is to provide a paint roller cleaning system that efficiently utilizes water.

An additional object is to provide a paint roller cleaning system that utilizes centrifugal forces to remove accumulated pain from the conventional paint roller.

A further object is to provide a paint roller cleaning system that utilizes centrifugal forces to stretch the sleeve fibers out thereby revitalizing the sleeve near its original condition.

A further object is to provide a paint roller cleaning system that automatically dries the sleeve when the water is turned off.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
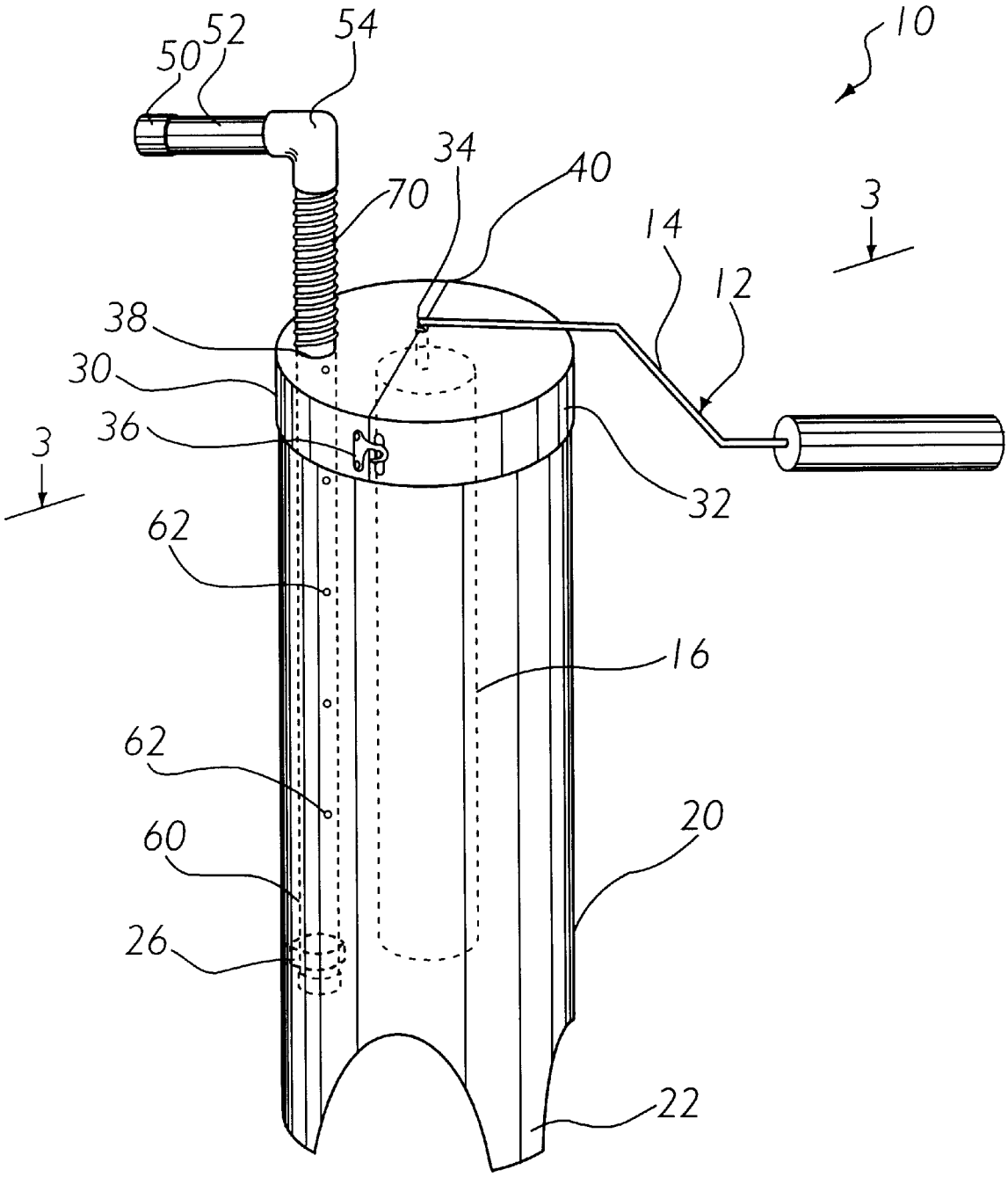
FIG. 1 is an upper perspective view of the present invention.

Turning now descriptively to the drawings, in which similar reference characters denote similar elements throughout the several view, FIGS. 1 through 4 illustrate a paint roller cleaning system 10, which comprises a housing 20, a first cover 30 attached to a portion of the open end, a second cover 32 pivotally attached to the housing 20 opposite of the first cover 30, a centrally positioned notch 34 within the first cover 30 and the second cover 32, a dispensing tube 60 having a plurality of nozzles 62 slidably extending through the first cover 30 through an aperture 38, an elbow member 54 attached to the dispensing tube 60, a compression spring 70 secured about the dispensing tube 60 between the first cover 30 and the elbow member 54, an entry tube 52 attached to the elbow member 54, and a hose coupler 50 secured to the entry tube 52 for threadably attaching to a conventional garden hose. Water supplied to the hose coupler 50 is dispensed through the nozzles 62 within the dispensing tube 60 toward the sleeve 16 of the conventional paint roller 12. As the water engages the sleeve 16, the sleeve 16 is rotated upon the conventional paint roller 12 while the user simultaneously lowers and raises the dispensing tube 60 to ensure complete saturation of the sleeve 16. As the sleeve 16 rotates the centrifugal force removes the water-paint mixture toward the interior walls of the housing 20 where after it drains to the bottom of the housing 20. The housing 20 is utilized to dispose of the water-paint mixture when finished cleaning the sleeve 16.

Typically, a conventional paint roller 12 includes an arm member 14 and a cylindrical frame that is rotatably supported upon the distal end of the arm member 14. The cylindrical frame removably receives a sleeve 16 that absorbs and dispenses the paint upon a wall or other structure.

Figure 2:
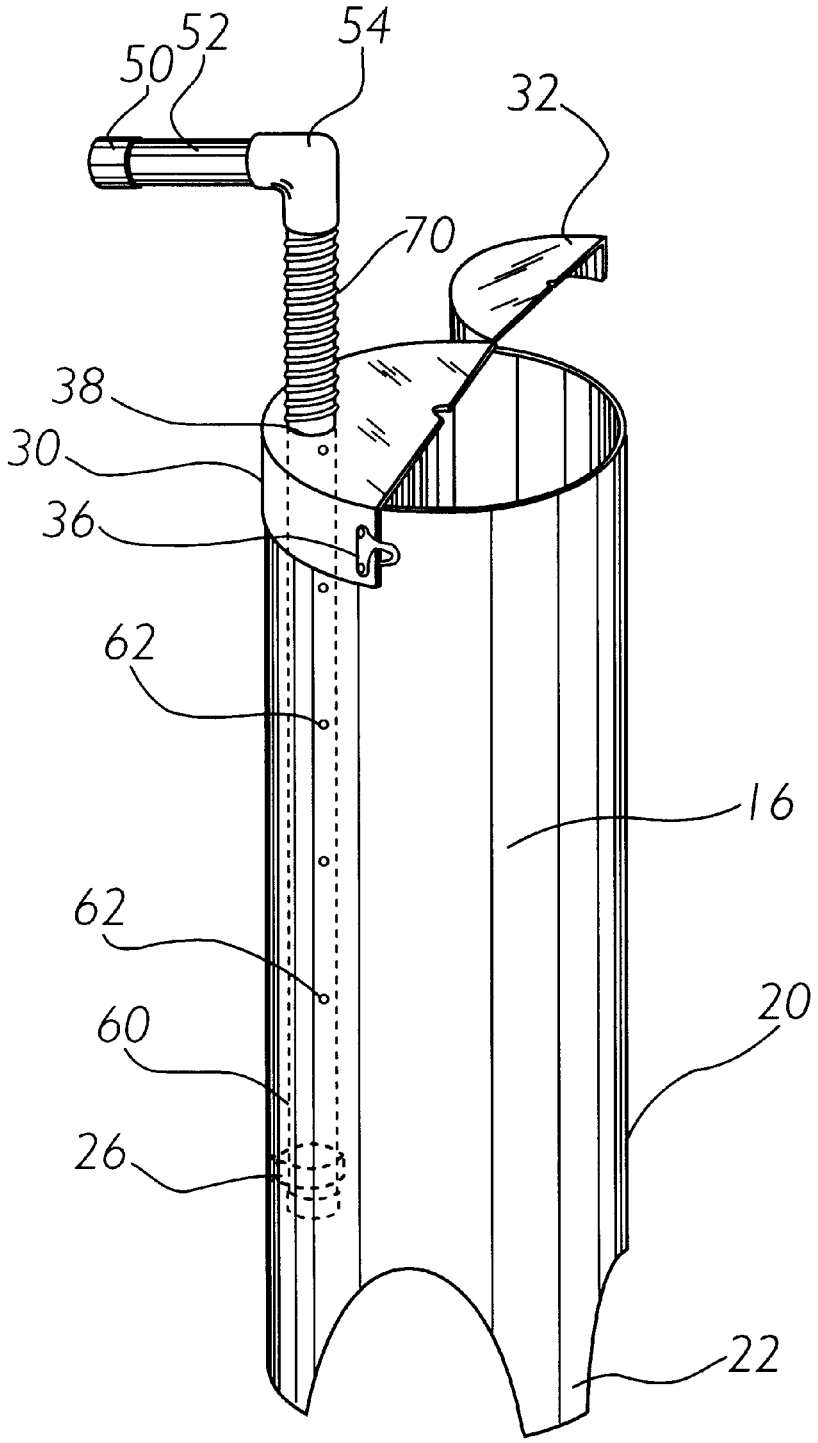
FIG. 2 is an upper perspective view of the present invention with the second cover in the open position.
Figure 4:
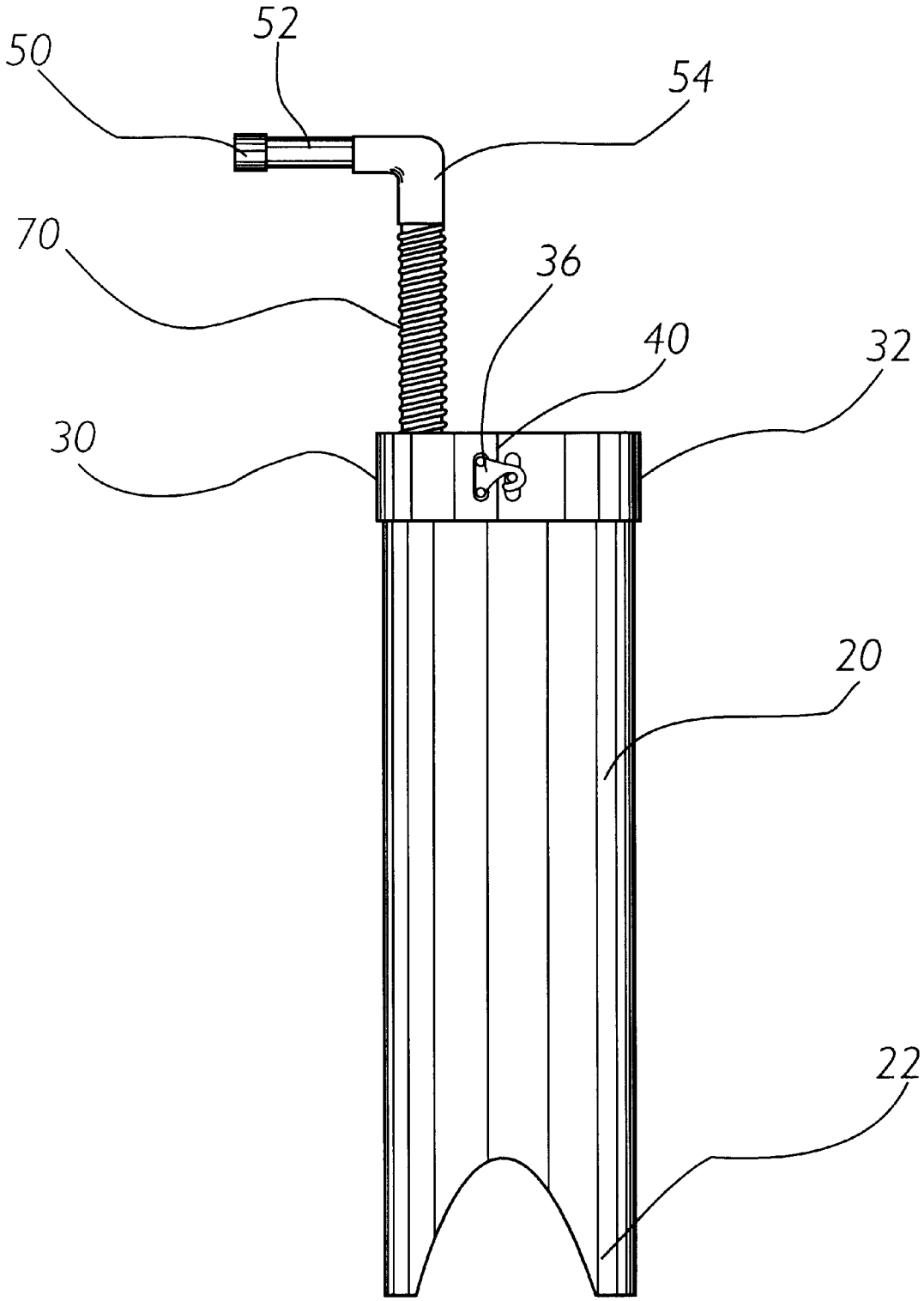
FIG. 4 is a side view of the present invention.

As shown in FIGS. 1, 2 and 4 of the drawings, the housing 20 is preferably of an elongated structure having an upper open end. A plurality of legs 22 are preferably attached to the bottom of the housing 20 for supporting the housing 20 during utilization. The housing 20 is preferably tubular shaped, however any other well-known shape may be utilized. The housing 20 is longer than the length of a conventional sleeve 16 that fits upon a conventional paint roller 12.

As shown in FIGS. 1 and 2 of the drawings, the first cover 30 is secured over a portion of the upper open end of the housing 20. The first cover 30 preferably covers half of the upper open end as shown in FIGS. 1 and 2 of the drawings. As shown in FIG. 1, a notch 34 extends into a central portion of the first cover 30.

As shown in FIGS. 1, 2 and 4 of the drawings, a second cover 32 is pivotally attached to the housing 20 or first cover 30 by a hinge 40. The second cover 32 surrounds the remaining portion of the upper open end of the housing 20 that is not covered by the first cover 30. A notch 34 extends into the second cover 32 that corresponds with the notch 34 into the first cover 30 thereby receiving the arm member 14 of the conventional paint roller 12. A latch 36 is attached to the first cover 30 that selectively engaging the second cover 32 when in the closed position as shown in FIGS. 1, 2 and 4 of the drawings.

Figure 3:
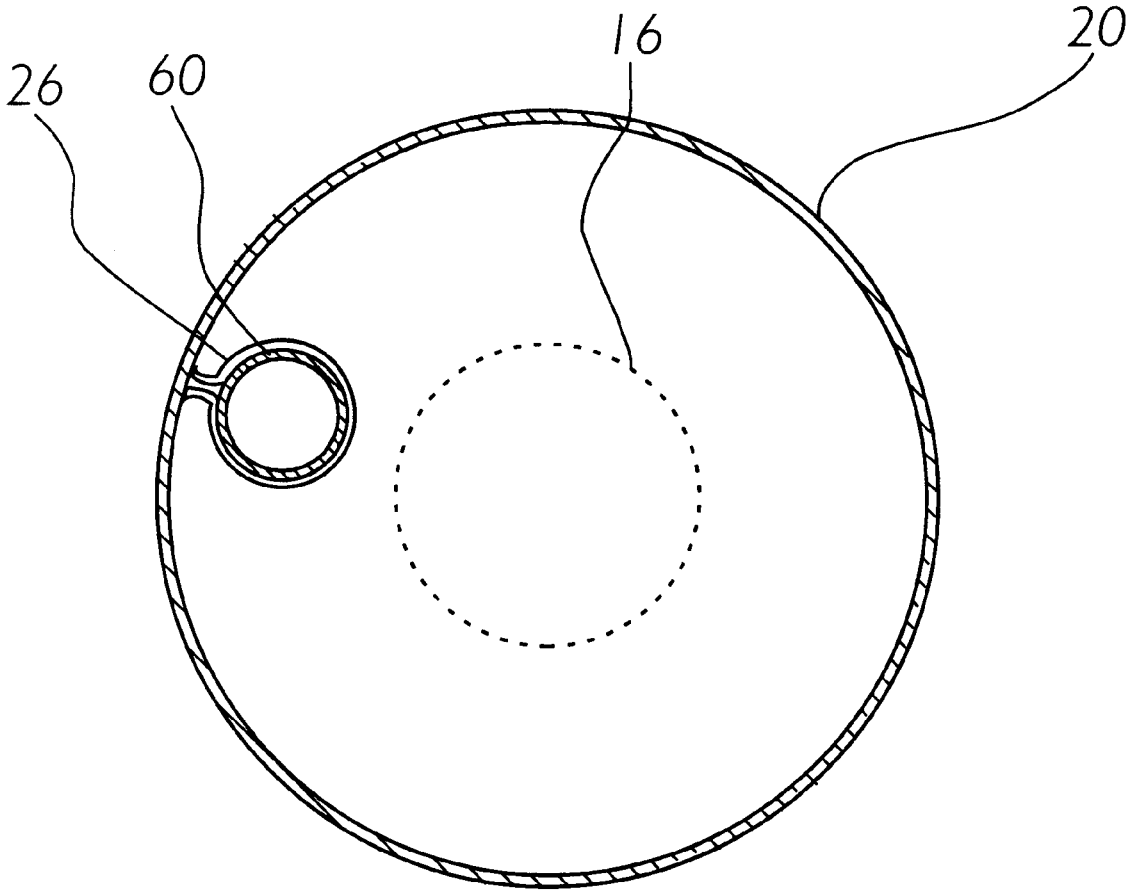
FIG. 3 is a cross sectional view taken along line 3—3 of FIG. 1 of the drawings.

As shown in FIGS. 1 and 2 of the drawings, a dispensing tube 60 slidably extends through an aperture 38 within the first cover 30. The dispensing tube 60 includes a plurality of nozzles 62 directed in substantially the same direction that direct the water toward the sleeve 16 of the conventional paint roller 12. A guide bracket 26 is attached to the interior wall of the housing 20 and slidably receives a lower portion of the dispensing tube 60 as shown in FIGS. 1 through 3 of the drawings.

As shown in FIGS. 1 and 2 of the drawings, an elbow member 54 is fluidly connected to the upper end of the dispensing tube 60. A compression spring 70 surrounds the dispensing tube 60 between the first cover 30 and the elbow member 54 as shown in FIG. 1 of the drawings.

As further shown in FIGS. 1 and 2 of the drawings, an entry tube 52 is fluidly connected to the elbow member 54. A hose coupler 50 is rotatably attached to the entry tube 52 for threadably and fluidly engaging a male end of a conventional garden hose.

In use, the user inserts a conventional paint roller 12 that has accumulated paint into the housing 20 through the upper open end when the second cover 32 is pivoted open. The user then positions the arm member 14 into the notch 34 of the first cover 30 as shown in FIG. 1 of the drawings. The user then closes the second cover 32 and then engages the latch 36 to prevent accidental opening of the second cover 32. The user then attaches the garden hose to the hose coupler 50 and then turns on the water pressure. The water flows from the garden hose into the entry tube 52 then through the elbow member 54 into the dispensing tube 60. The pressurized water is thereafter dispersed from the plurality of nozzles 62 within the dispensing tube 60 toward the sleeve 16 of the conventional paint roller 12. Initially, the user directs the water toward the center of the sleeve 16 while lowering and raising the dispensing tube 60 in order to soak the sleeve 16 with water. After a finite period of time, the user then redirects the water toward the edge of the sleeve 16 thereby causing the sleeve 16 to rotate very fast. Centrifugal force causes the water-paint mixture within the sleeve 16 to emanate from the sleeve 16 toward the inner walls of the housing 20. The water-paint mixture then drains toward the bottom of the housing 20 wherein the sleeve 16 is elevated away from. The user continues to raise and lower the dispensing tube 60 with the compression spring 70 lifting the dispensing tube 60 upwardly after the user pushes the dispensing tube 60 downwardly. After the user is satisfied that the sleeve 16 has been completely cleaned, the user can leave the conventional paint roller 12 within the housing 20 for a period of time and then remove for utilization. The waste water-paint mixture can then be disposed of properly to avoid contaminating the ground surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint roller cleaning system, comprising:

a housing having an open end, wherein said housing is large enough to receive a sleeve of a paint roller;

a first cover attached to a portion of said open end of said housing;

a second cover removably attachable to said open end for enclosing said open end with said first cover;

a first notch within said first cover and a second notch within said second cover, wherein said first notch and said second notch form an opening that is large enough to receive an arm member of said paint roller; and a water spray means within said housing for spraying water upon a sleeve of said paint roller.

2. The paint roller cleaning system of claim 1, wherein said water spray means comprises:

a dispensing tube that extends through an aperture within said first cover, wherein said dispensing tube is connectable to a water source; and a plurality of nozzles within said dispensing tube for directing a plurality of streams of water toward said sleeve.

3. The paint roller cleaning system of claim 2, wherein said dispensing tube is rotatable within said first cover.

4. The paint roller cleaning system of claim 3, including a guide bracket attached within said housing for rotatably and slidably receiving a lower end of said dispensing tube.

5. The paint roller cleaning system of claim 4, wherein said second cover is pivotally attached to said first cover.

6. The paint roller cleaning system of claim 5, including a latch attached to said first cover for selectively securing said second cover in a closed position.

7. The paint roller cleaning system of claim 6, wherein said dispensing tube is slidably positioned within said aperture of said first cover.

8. The paint roller cleaning system of claim 7, including a spring means for elevating said dispensing tube.

9. The paint roller cleaning system of claim 8, including:

an elbow member fluidly connected to the dispensing tube;

an entry tube fluidly connected to the elbow member; and a hose coupler rotatably attached to the entry tube for allowing threadable engagement with a male end of a garden hose.

10. The paint roller cleaning system of claim 9, wherein said spring means comprises a compression spring positioned about said dispensing tube between said first cover and said elbow member.

11. A paint roller cleaning system, comprising:

a housing having an open end, wherein said housing is large enough to receive a sleeve of a paint roller;

said housing is tubular shaped and has a reservoir portion in a lower portion of said housing when said sleeve is positioned within;

a first cover attached to a portion of said open end of said housing;

a second cover removably attachable to said open end for enclosing said open end with said first cover;

a first notch within said first cover and a second notch within said second cover, wherein said first notch and said second notch form an opening that is large enough to receive an arm member of said paint roller; and a water spray means within said housing for spraying water upon a sleeve of said paint roller.

12. The paint roller cleaning system of claim 11, wherein said water spray means comprises:

a dispensing tube that extends through an aperture within said first cover, wherein said dispensing tube is connectable to a water source; and a plurality of nozzles within said dispensing tube for directing a plurality of streams of water toward said sleeve.

13. The paint roller cleaning system of claim 12, wherein said dispensing tube is rotatable within said first cover.

14. The paint roller cleaning system of claim 13, including a guide bracket attached within said housing for rotatably and slidably receiving a lower end of said dispensing tube.

15. The paint roller cleaning system of claim 14, wherein said second cover is pivotally attached to said first cover.

16. The paint roller cleaning system of claim 15, including a latch attached to said first cover for selectively securing said second cover in a closed position.

17. The paint roller cleaning system of claim 16, wherein said dispensing tube is slidably positioned within said aperture of said first cover.

18. The paint roller cleaning system of claim 17, including a spring means for elevating said dispensing tube.

19. The paint roller cleaning system of claim 18, including:

an elbow member fluidly connected to the dispensing tube;

an entry tube fluidly connected to the elbow member; and a hose coupler rotatably attached to the entry tube for allowing threadable engagement with a male end of a garden hose.

20. The paint roller cleaning system of claim 19, wherein said spring means comprises a compression spring positioned about said dispensing tube between said first cover and said elbow member.

* * * * *